US010508392B2

(12) United States Patent
Jackson et al.

(10) Patent No.: US 10,508,392 B2
(45) Date of Patent: Dec. 17, 2019

(54) BRIDGE OVERHANG BRACKET ASSEMBLY WITH ADJUSTABLE SIDE MEMBER

(71) Applicants: Barry Walter Jackson, Mississauga (CA); David George Jackson, Mississauga (CA); Scott Fisk, Uniontown, OH (US)

(72) Inventors: Barry Walter Jackson, Mississauga (CA); David George Jackson, Mississauga (CA); Scott Fisk, Uniontown, OH (US)

( * ) Notice: Subject to any disclaimer, the term of this patent is extended or adjusted under 35 U.S.C. 154(b) by 0 days.

(21) Appl. No.: 16/251,725

(22) Filed: Jan. 18, 2019

(65) Prior Publication Data

US 2019/0226165 A1 Jul. 25, 2019

Related U.S. Application Data

(60) Provisional application No. 62/619,339, filed on Jan. 19, 2018.

(51) Int. Cl.

| | |
|---|---|
| ***E01D 21/00*** | (2006.01) |
| ***E04G 13/06*** | (2006.01) |
| ***E04G 17/18*** | (2006.01) |

(52) U.S. Cl.

CPC ..... *E01D 21/00* (2013.01); *E04G 13/066* (2013.01); *E04G 17/18* (2013.01)

(58) Field of Classification Search

CPC ..... E01D 21/00; E04G 13/066
USPC ..... 14/78
See application file for complete search history.

(56) References Cited

U.S. PATENT DOCUMENTS

| | | | | |
|---|---|---|---|---|
| 2,195,579 | A * | 4/1940 | Murdock | E04G 5/06 248/242 |
| 2,414,538 | A | 1/1947 | Lamb | |
| 4,470,574 | A | 11/1984 | Jackson | |
| 5,112,155 | A | 5/1992 | Jackson | |
| 5,273,415 | A | 12/1993 | Jackson | |
| 5,310,153 | A | 5/1994 | Jackson | |
| 5,318,148 | A * | 6/1994 | Franco | E04D 15/00 182/45 |
| 5,326,065 | A | 7/1994 | Jackson | |
| 5,524,854 | A | 6/1996 | McSwain et al. | |
| 5,813,185 | A | 9/1998 | Jackson | |
| 6,059,258 | A | 5/2000 | Jackson | |
| 6,065,254 | A * | 5/2000 | Lanka | E04G 17/14 248/354.3 |
| 7,032,268 | B2 | 4/2006 | Jackson | |

(Continued)

FOREIGN PATENT DOCUMENTS

| | | |
|---|---|---|
| CA | 2122736 A1 | 5/1993 |
| CA | 2130119 C | 8/1993 |

(Continued)

*Primary Examiner* — Raymond W Addie
(74) *Attorney, Agent, or Firm* — Price Heneveld LLP

(57) ABSTRACT

A bridge overhang bracket assembly includes a top member, a diagonal member and a side member. The top and diagonal members are pivotally attached proximate to respective outer and upper ends thereof. The top and side members are pivotally attached proximate to respective inner and top ends thereof. The diagonal and side members are pivotally attached proximate to respective lower and bottom ends thereof. The side member is configured so that its length between the bottom and top ends is adjustable.

16 Claims, 11 Drawing Sheets

(56) References Cited

U.S. PATENT DOCUMENTS

| | | | | |
|---|---|---|---|---|
| 7,159,262 | B2 | 1/2007 | Jackson | |
| 7,360,341 | B2 | 4/2008 | Jackson et al. | |
| 8,529,157 | B2 * | 9/2013 | McKay ..... | E02B 3/068<br>248/242 |
| 2008/0111040 | A1 | 5/2008 | Jackson et al. | |

FOREIGN PATENT DOCUMENTS

| | | | |
|---|---|---|---|
| CA | 2138795 | A1 | 4/1994 |
| CA | 2130451 | C | 7/1994 |
| CA | 2118170 | A1 | 4/1996 |
| CA | 2203978 | C | 10/1997 |
| CA | 2249921 | C | 4/1999 |
| CA | 2440612 | A1 | 3/2004 |
| CA | 2444449 | C | 4/2005 |
| CA | 2496089 | A1 | 8/2006 |
| CA | 2534944 | C | 8/2006 |
| GB | 2146687 | A | 4/1985 |
| GB | 2146728 | A | 4/1985 |
| WO | 9309311 | A1 | 5/1993 |
| WO | 9316253 | A1 | 8/1993 |
| WO | 9415045 | A1 | 7/1994 |
| WO | 9425705 | A2 | 11/1994 |

* cited by examiner

BRIDGE OVERHANG BRACKET ASSEMBLY WITH ADJUSTABLE SIDE MEMBER

CROSS-REFERENCE TO RELATED APPLICATION

This application claims priority to U.S. Provisional Application No. 62/619,339 filed on Jan. 19, 2018, the entire contents of which are hereby incorporated herein by reference.

FIELD OF INVENTION

The present disclosure relates generally to shoring devices, for example, brackets used for bridge overhangs.

BACKGROUND OF INVENTION

The following paragraphs are not an admission that anything discussed in them is prior art or part of the knowledge of persons skilled in the art.

U.S. Pat. No. 7,032,268 discloses a bridge overhang bracket that includes an elongate top member having inner and outer ends an elongate diagonal member having an inner end and an outer end, the outer end of the diagonal member pivotally attached to the outer end of the top member, upper and lower pivot joints secured to the top member and diagonal member, respectively, adjacent the respective inner ends thereof, and an elongate side member extending between and engaged with the upper and lower pivot joints. At least one of the pivot joints comprises an adjustable axial engagement mechanism for adjusting the position along the length of the side member at which the at least one pivot joint engages the side member.

U.S. Pat. No. 7,159,262 discloses an overhang bracket that has a top member, a side member and a diagonal member. The side and top member may be connected together through a removable connecter. A guardrail post holder allows a guardrail post to be installed at a variety of angles to the top member. Rotating the side member causes the diagonal member to translate up or down the side member. A side member locator extends upwards from the overhang bracket to indicate the location of the side member. A tie rod holder holds a tie rod in an offset position relative to the side member. The side member locator may extend upwards through further parts of the shoring system or bridge overhang structure, for example a floor of a concrete form or rebar. A worker may adjust the overhang bracket in place from a standing position on a supporting structure or the floor of the form.

INTRODUCTION

The following is intended to introduce the reader to the detailed description that follows and not to define or limit the claimed subject matter.

In an aspect, the present disclosure relates to a bridge overhang bracket assembly that can include: a top member extending lengthwise between inner and outer ends; a diagonal member extending lengthwise between lower and upper ends, the top and diagonal members being pivotally attached proximate to the respective outer and upper ends thereof; and a side member extending lengthwise between bottom and top ends, the top and side members being pivotally attached proximate to the respective inner and top ends thereof, the diagonal and side members being pivotally attached proximate to the respective lower and bottom ends thereof. The side member can be configured so that its length between the bottom and top ends is adjustable.

In an aspect, the present disclosure relates to an adjustable side member for use in a bridge overhang bracket assembly, the bridge overhang bracket assembly including top and diagonal members. The adjustable side member can include: a threaded rod for pivotal attachment to the top member; an upper strut including a nut bracket having an internal thread engaging the threaded rod so that rotating the threaded member about its longitudinal axis adjusts a length of the side member; and a lower strut for pivotal attachment to the diagonal member, the lower strut fastenable to the upper strut according to a plurality of longitudinal positions to adjust the length of the side member.

In an aspect, the present disclosure relates to a bridge overhang bracket assembly that can include: a top member extending lengthwise between inner and outer ends; a diagonal member extending lengthwise between lower and upper ends, the top and diagonal members being pivotally attached proximate to the respective outer and upper ends thereof; and a side member extending lengthwise between bottom and top ends, the top and side members being pivotally attached proximate to the respective inner and top ends thereof, the diagonal and side members being pivotally attached proximate to the respective lower and bottom ends thereof, the side member including upper and lower struts that are fastenable together in a plurality of longitudinal positions so that the length of the side member is adjustable, the side member including a threaded member that is coupled to the upper strut such that rotating the threaded member further adjusts the length of the side member.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION OF THE INVENTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Bridge overhang brackets are described in U.S. Pat. Nos. 7,032,268 and 7,159,262 and application Ser. No. 15/726,513, now U.S. Patent Application Publication No. 2019/0106891, and the entire contents of each are hereby incorporated herein by reference.

Figure 1:
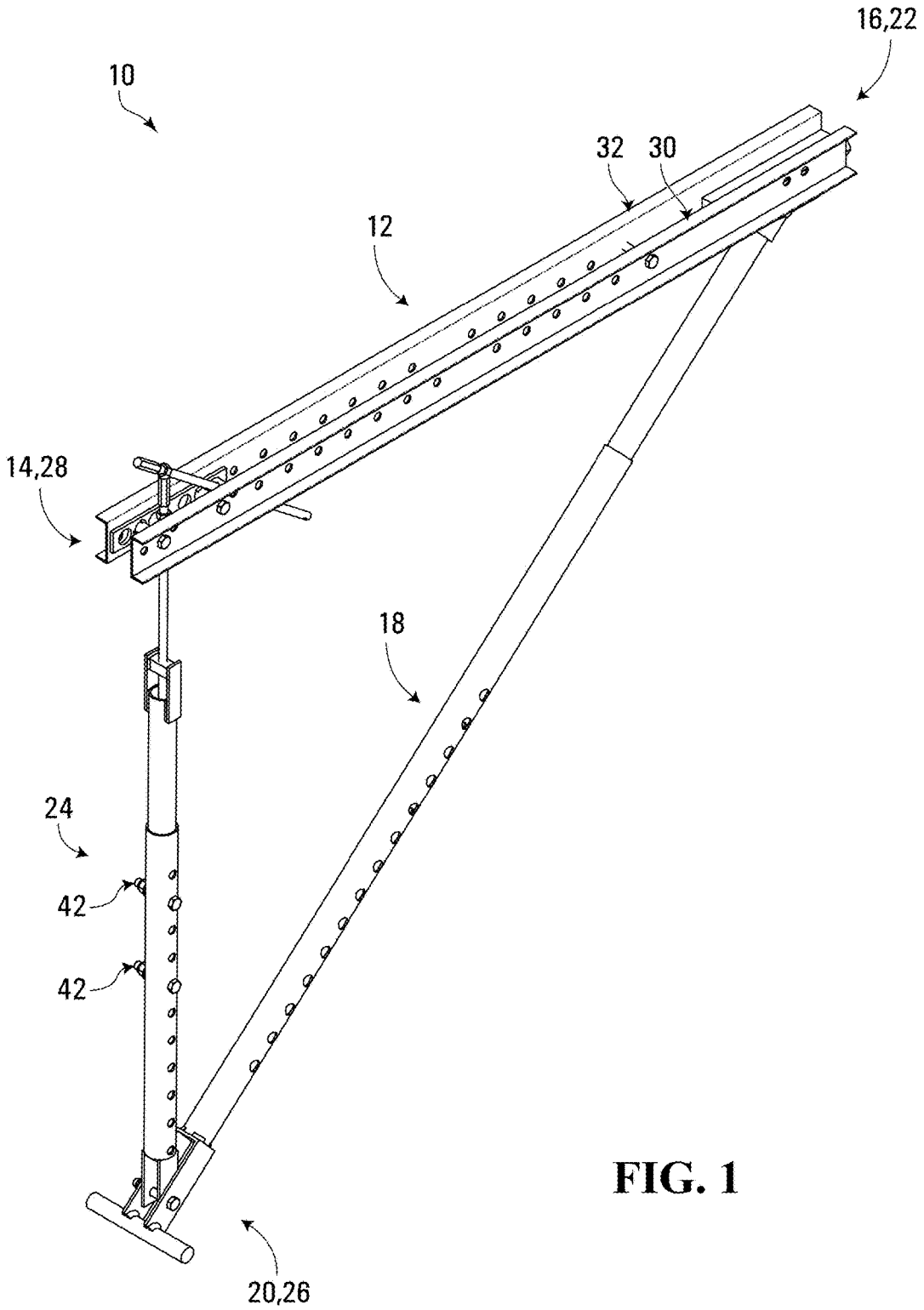
FIGS. 1, 2 and 3 are upper perspective, lower perspective and side views, respectively, of an example of a bridge bracket overhang assembly.
Figure 2:
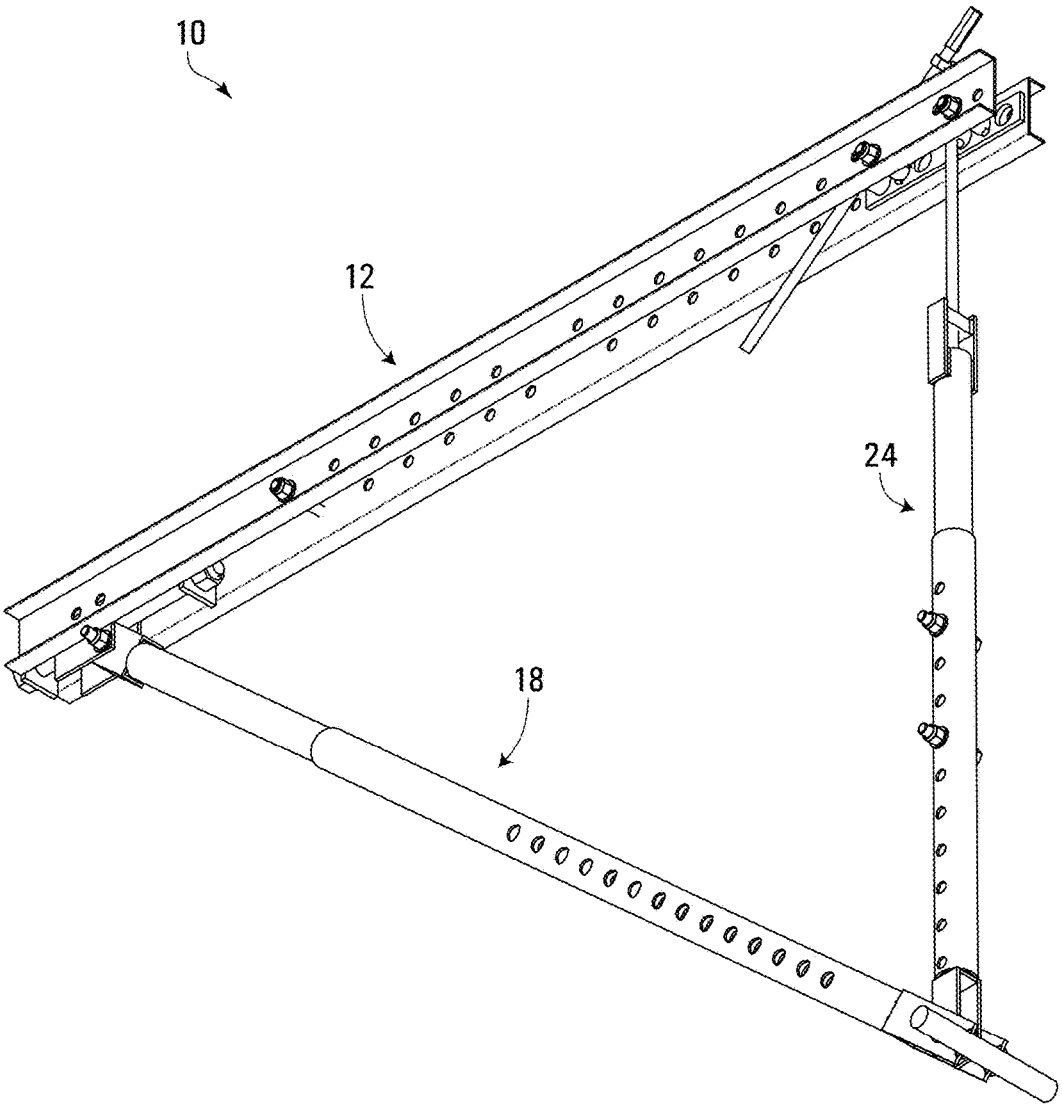
Figure 3:
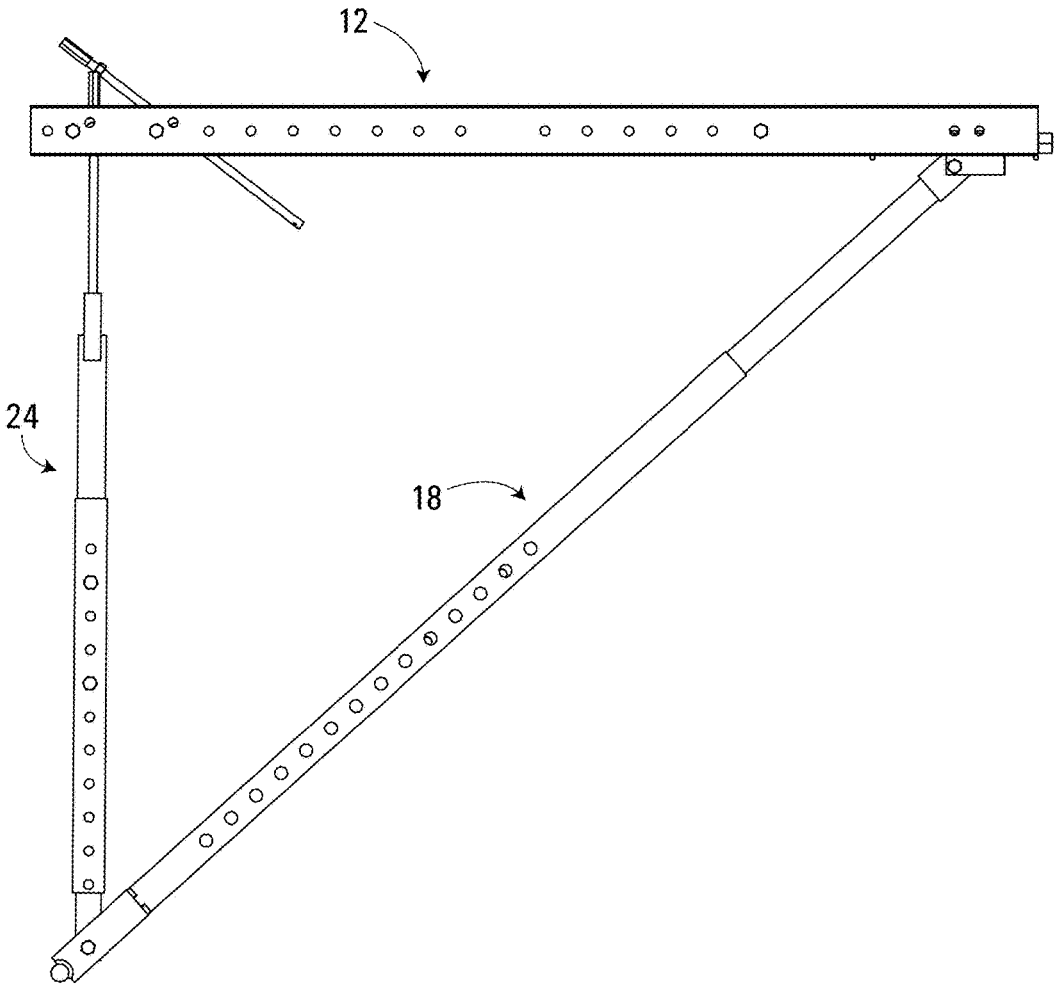

Referring to FIGS. 1, 2 and 3, an example of a bridge overhang bracket assembly is shown generally at reference numeral 10. In the example illustrated, the assembly 10 has three elongate members, namely, a top member 12 extending lengthwise between inner and outer ends 14, 16, a diagonal member 18 extending lengthwise between lower and upper ends 20, 22, and an adjustable side member 24 extending lengthwise between bottom and top ends 26, 28.

Components of the assembly 10 can be made primarily of steel, although other materials can also be used.

In use, ends 14, 20 are nearest the beam or other supporting structure (not shown), while the ends 16, 22 are the outboard ends of the respective members 12, 18, furthest from the beam.

In use, the top member 12 is often generally horizontal or angled slightly upward, for example with an angle of between 0 and 20 degrees to the horizontal. The side member 24 is generally vertical, for example within 30 degrees of vertical. However, the terms top, diagonal and side are used herein to assist in describing the assembly 10, and are not intended to be limiting. The top and side members 12, 24 can depart significantly from the horizontal and vertical, respectively.

In the example illustrated, the top member 12 is shown to be formed of first and second channel members 30, 32, which are arranged in parallel. The channel members 30, 32 can have a generally C-channel shape as shown. Corresponding sets of aligned holes are provided in the channel members 30, 32.

Figure 4:
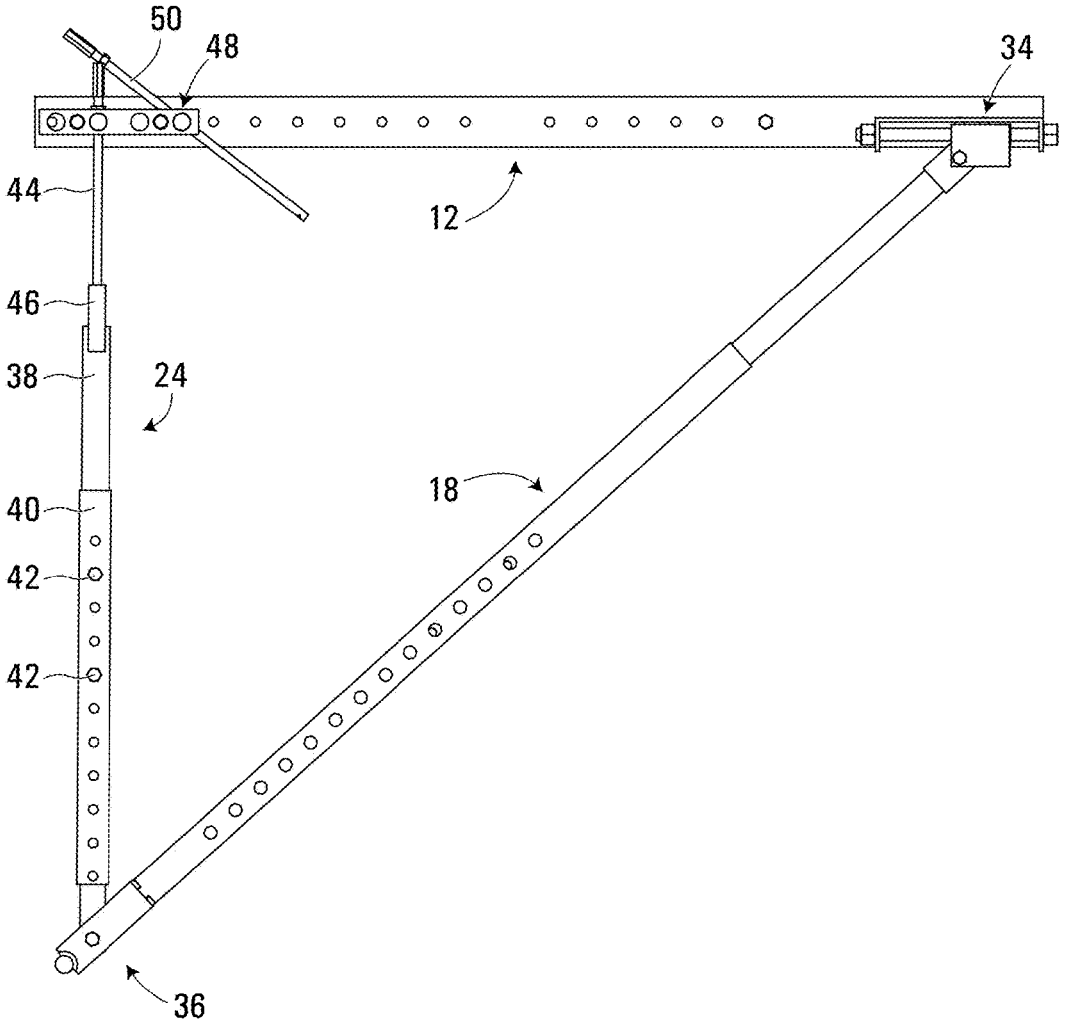
FIG. 4 is a side view of the bridge bracket overhang assembly in which a portion of a top member has been removed.

Referring to FIGS. 1 and 4, the top and diagonal members 12, 18 are shown pivotally attached by a first connector 34 that is proximate to the outer and upper ends 16, 22. The diagonal and side members 18, 24 are shown pivotally attached by a second connector 36 that is proximate to the lower and bottom ends 20, 26. The second connector 36 is shown to include a bumper for bearing against the supporting structure (not shown).

Referring in particular to FIG. 4, the side member 24 is shown to include an upper strut 38 and a lower strut 40. In the example illustrated, the struts 38, 40 are tubular members with the upper strut 38 received telescopically by the lower strut 40. The struts 38, 40 each include a plurality of holes that extend transversely therethrough. The length of the side member 24 can be adjusted by aligning selected ones of the holes and inserting fasteners 42 to fix the struts 38, 40 in a series of longitudinal positions. This provides a first means of adjusting the length of the side member 24, which is finite and relatively coarse. The particular pair of aligned holes to use can be selected to assist in roughly adjusting the assembly 10 to fit the shape and size of a particular supporting structure, and/or to place the diagonal member 18 in a desired location to assist the top member 12 in supporting its intended load.

In the example illustrated, the side member 24 includes a threaded rod 44, and the upper strut 38 includes a nut bracket 46 disposed at an upper end thereof for engaging the threaded rod 44.

In the example illustrated, a hanger element 48 is mounted to the top member 12. In the example illustrated, the hanger element 48 is fastened between the channel members 30, 32, proximate to the inner end 14. In the example illustrated, the hanger element 48 is attached to the threaded rod 44 and a tie rod 50.

Figure 5:
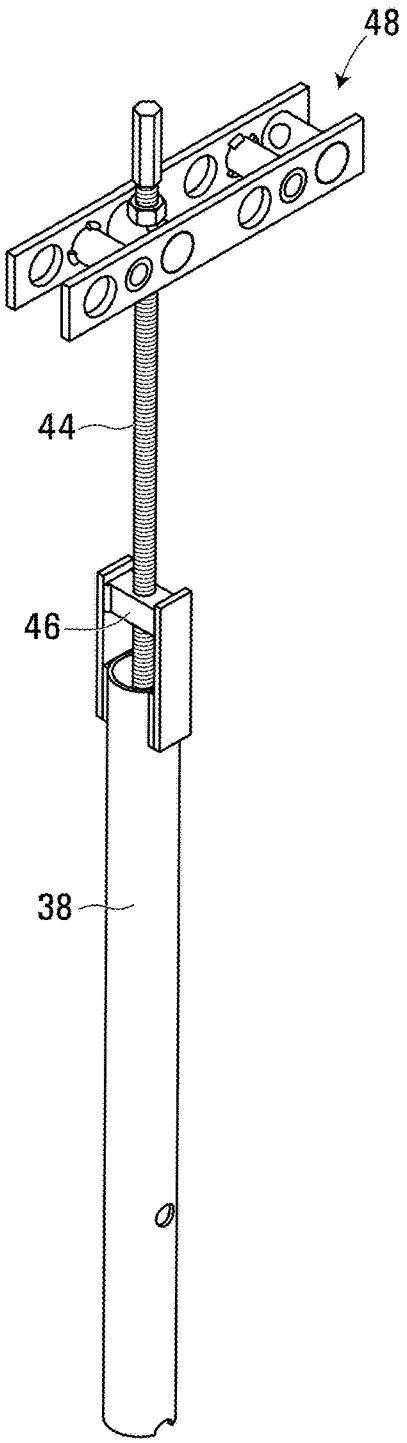
FIGS. 5 and 6 are perspective and exploded views, respectively, of a portion of a side member of the bridge bracket overhang assembly.
Figure 6:
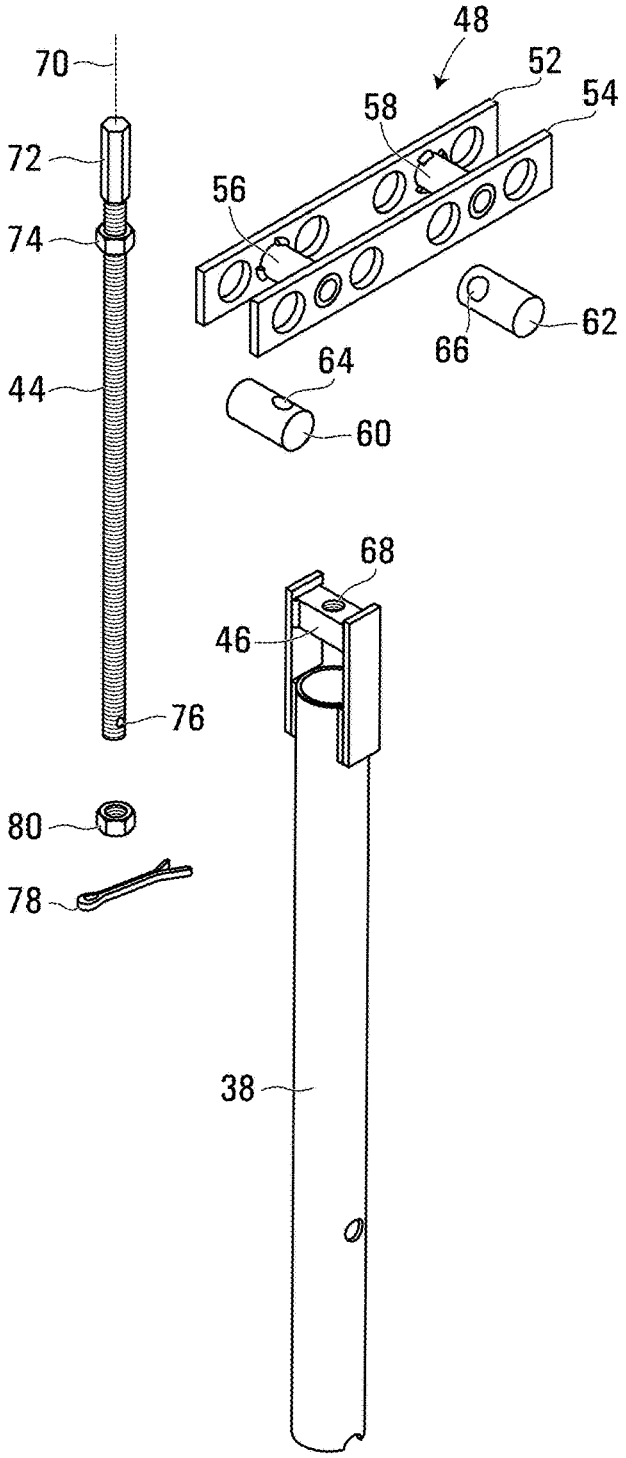

Referring now to FIGS. 5 and 6, the hanger element 48 includes first and second plates 52, 54, and bars 56, 58 are fixed therebetween. The plates 52, 54 include a plurality of holes aligned in registration that receive pivot pins 60, 62 in sliding fit and permit the pivot pins 60, 62 to rotate about their axes. The pivot pin 60 includes a cross bore 64 that extends generally perpendicular to the axis of the pin 60 and is positioned intermediately along the length of the pin 60. The cross bore 64 is sized to receive the threaded rod 44 in sliding fit. The pivot pin 62 includes a cross bore 66 that extends generally perpendicular to the axis of the pin 62 and is positioned intermediately along the length of the pin 62. The cross bore 66 is sized to receive the tie rod 50 in sliding fit. A fastener (not shown) can be tightened against the pivot pin 62 to bring the tie rod 50 into tension.

In the example illustrated, the plates 52, 54 include four sets of holes for receiving the two pivot pins 60, 62, which allows for some adjustment, and it will be appreciated that the number of holes can vary.

In the example illustrated, the nut bracket 46 includes an internal thread 68 that engages the threaded rod 44. The threaded rod 44 is rotatable about its longitudinal axis 70 to move the internal thread 68 along an axial length of the threaded rod 44, such that the side member 24 can be lengthened or shortened as desired. This provides a second means of adjusting, with infinite adjustability, the length of the side member 24, permitting fine adjustment of the position of the threaded rod 44 relative to the nut bracket 46 and hence the upper strut 38.

In the example illustrated, an upper end of the threaded rod 44 includes a gripping surface 72 that can facilitate using a tool to rotate the threaded rod 44. As shown, the gripping surface 72 can be a hexagonal shape forged into or attached to the upper end of the threaded rod 44. The gripping surface 72 can be sized and shaped to accept a standard socket wrench.

Also at the upper end of the threaded rod 44, a nut 74 can be welded or otherwise fixed in place. The nut 74 can provide a stop that defines a lowermost position of the threaded rod 44 relative to the upper strut 38.

At a lower end of the threaded rod 44, an aperture 76 is configured to receive a cotter pin 78, which is positioned in combination with a nut 80. The nut 80 can be a castellated nut. In use, the cotter pin 78 and the nut 80 are housed within the upper strut 38 and cooperate as a stop that defines an uppermost position of the threaded rod 44 relative to the upper strut 38. In this manner, the cotter pin 78 and the nut 80 act as a safety device to prevent the threaded rod 44 from being unscrewed out of the nut bracket 46 and separated from the upper strut 38. Alternatively, other devices such as other locking nuts, a cotter pin through a hole in the threaded rod 44 or a pair of nuts tightened against each other can also be used.

Figure 7:
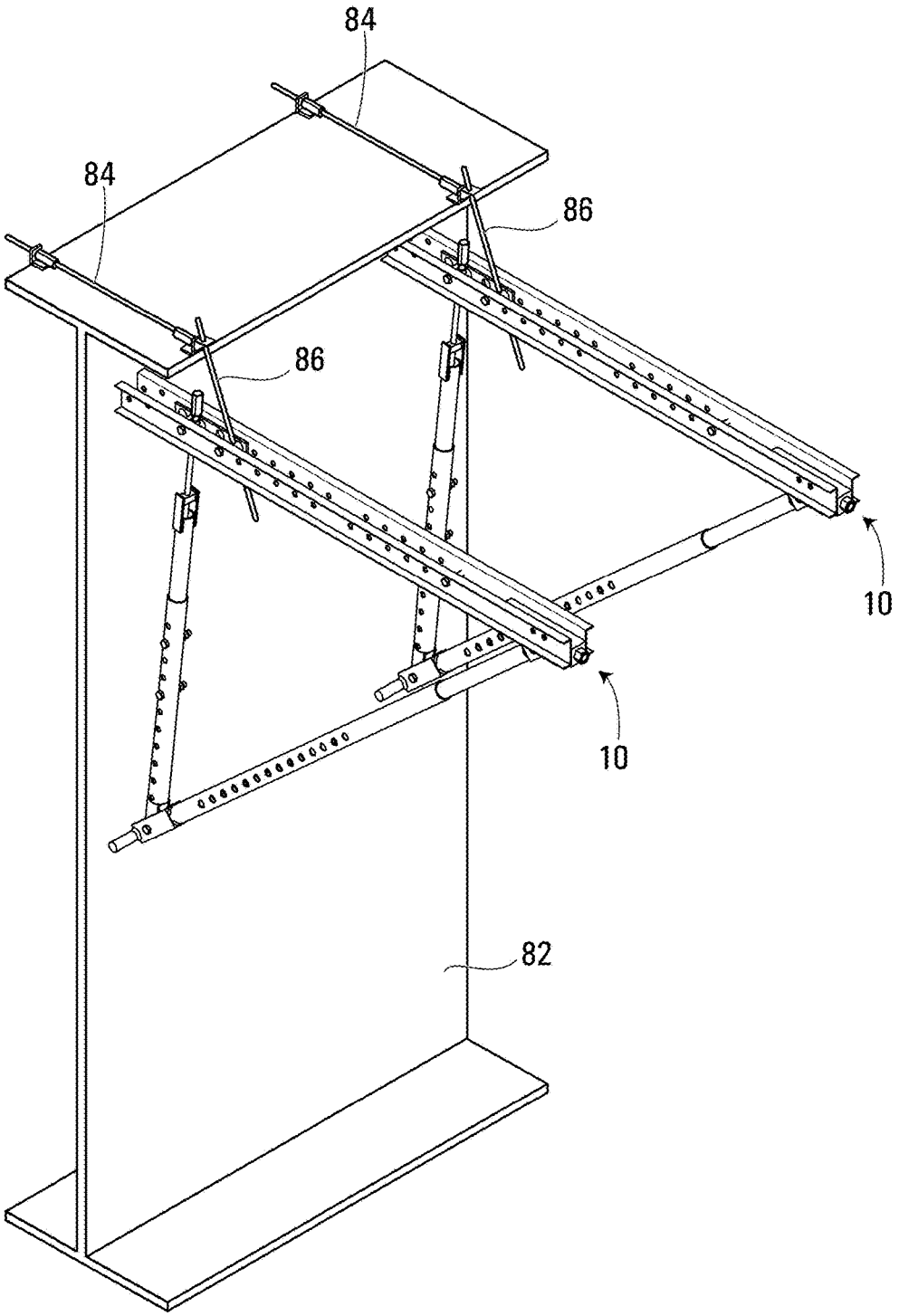
FIGS. 7 and 8 are upper and lower perspective views, respectively, of bridge bracket overhang assemblies installed onto a bridge girder/beam.
Figure 8:
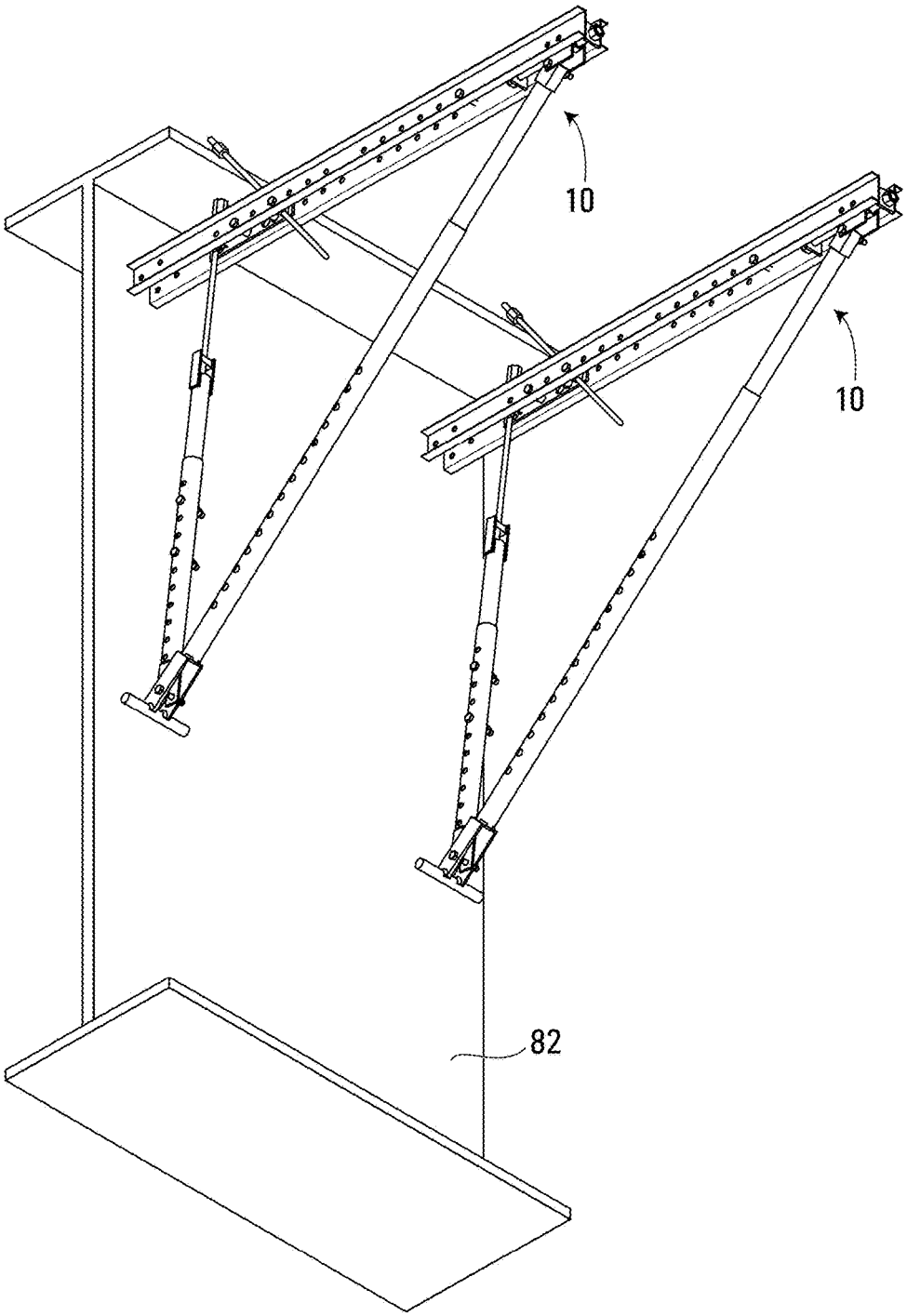

FIGS. 7 and 8 show a concrete beam or girder 82. A hanger rod 84 is affixed to the beam 82, and a tie rod 86 couples the hanger rod 84 and its respective bridge overhang bracket assembly 10.

In use, the assembly 10 can be assembled on the ground, using construction drawings to assemble to an approximate shape. For each of the assemblies 10, the length of the side member 24 can be roughly adjusted before hanging the assembly 10 from a supporting structure by fixing the upper strut 38 relative to the lower strut 40 at a desired position. The assembly 10 can then be hung from the support structure 82 by passing the tie rods 86 extending between the assembly 10 and the hanger rods 84. To adjust the assembly 10, a worker standing above can engage the gripping surface 72 (FIG. 6) of the side member 24 with a suitable tool (not shown). Accordingly, it should be appreciated that a benefit of the adjustable side member 24 is safety, because the workers do not need to climb out on the assembly 10 to make the adjustment. The threaded rod 44 of the side member 124 can then be rotated to provide a fine adjustment of the length of the side member 124 between connections with the top member 12 and diagonal member 18. In this way, a set of assemblies 10 can be finely adjusted in place, optionally after a form (not shown) has been placed over them. For example, the assemblies 10 can be adjusted so that, despite variations in the size or shape of the supporting structure and/or form along their lengths, a smooth floor at the proper orientation can be achieved across a number of assemblies 10.

Figure 9:
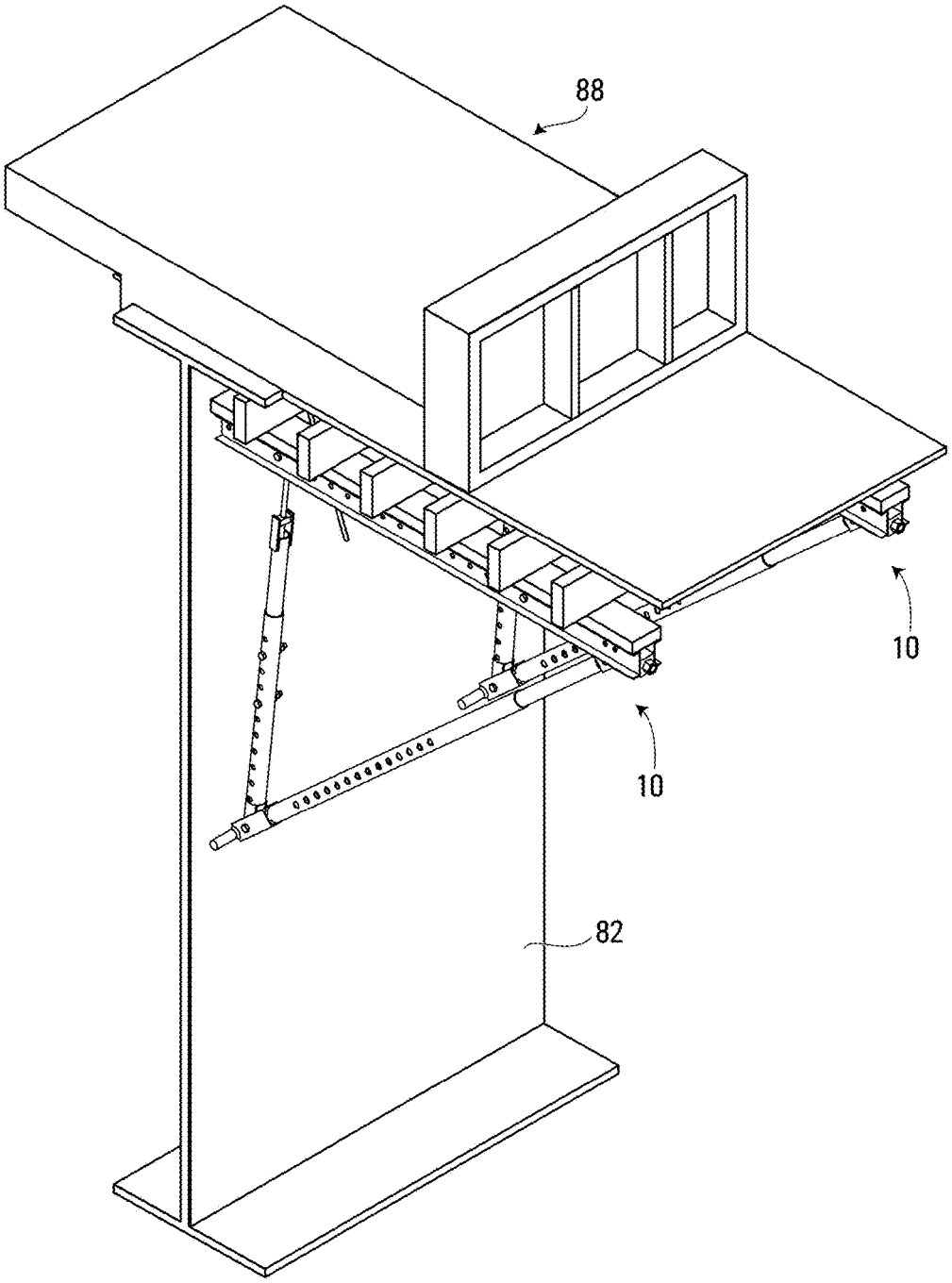
FIGS. 9, 10 and 11 are upper perspective, lower perspective and side views, respectively, of a bridge deck installed onto the bridge bracket overhang assemblies and the bridge girder/beam.
Figure 10:
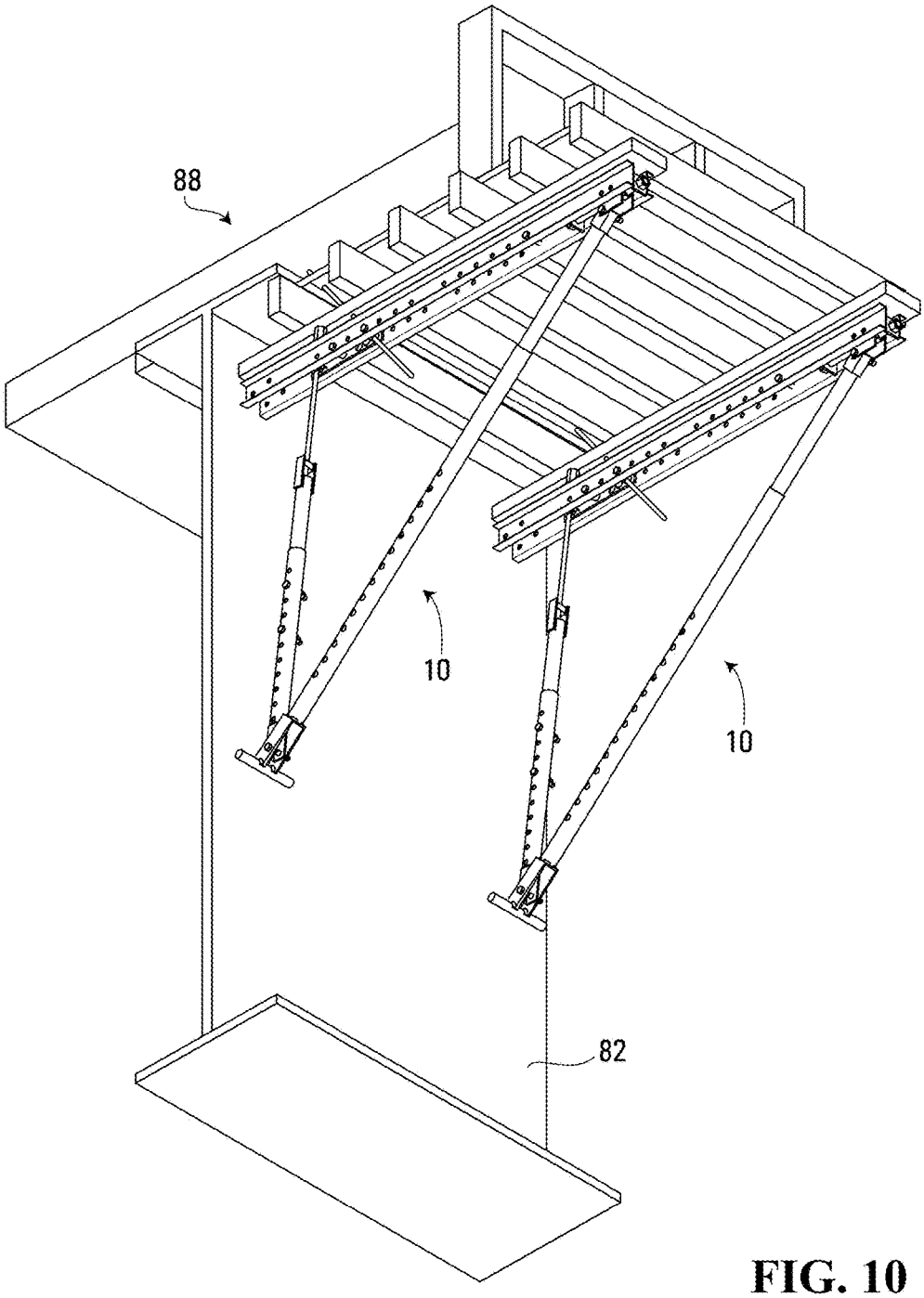
Figure 11:
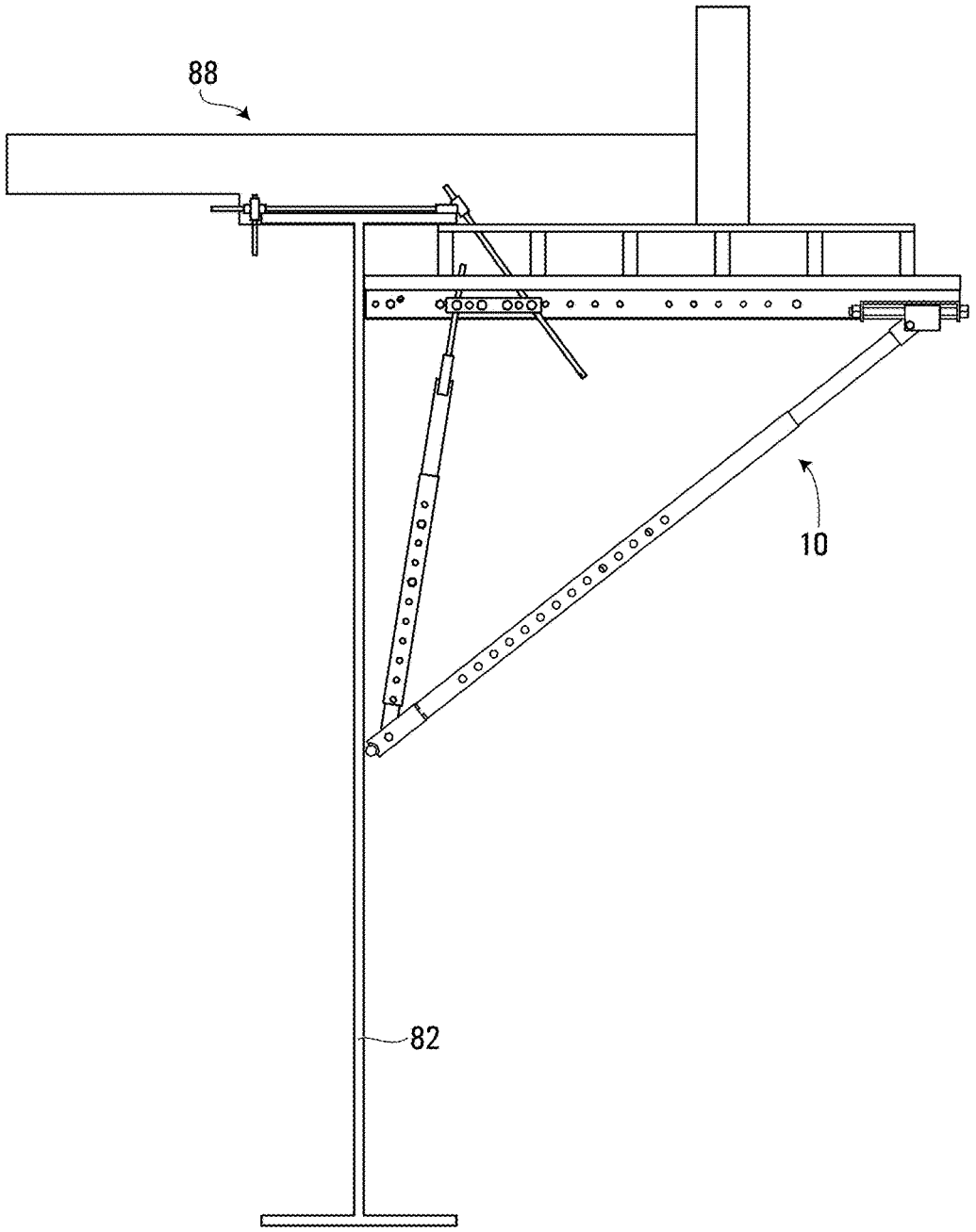

FIGS. 9, 10 and 11 show the assemblies 10 supporting a bridge deck 88. To facilitate adjustment of the assembly 10 by a person standing on the top deck area of a bridge being built, an opening (not shown) can be made in the floor of a form to allow access to the gripping surface 72 (FIG. 6) of the side member 24.

It will be appreciated that components of the adjustable side member 24 and the hanger element 48 can be supplied in a kit for retrofitting existing bridge overhang brackets, including, for example but without limitation, bridge overhang brackets manufactured by Dayton Superior™.

While the above description provides examples of one or more apparatuses or methods, it will be appreciated that other apparatuses or methods may be within the scope of the accompanying claims.

The invention claimed is:

1. A bridge overhang bracket assembly, comprising:

a top member extending lengthwise between inner and outer ends;

a diagonal member extending lengthwise between lower and upper ends, the top and diagonal members being pivotally attached proximate to the respective outer and upper ends thereof;

a side member extending lengthwise between bottom and top ends, the top and side members being pivotally attached proximate to the respective inner and top ends thereof, the diagonal and side members being pivotally attached proximate to the respective lower and bottom ends thereof;

wherein the side member is configured so that its length between the bottom and top ends is adjustable;

wherein the side member comprises at least one strut;

wherein the at least one strut comprises upper and lower struts that are fastenable together in a plurality of longitudinal positions so that the length of the side member is adjustable;

wherein the upper and lower struts are each tubular members and one is received telescopically by the other; and wherein the side member comprises a threaded member that is coupled to the at least one strut such that rotating the threaded member adjusts the length of the side member.

2. The assembly of claim 1, further comprising:

fasteners to fix a position of the upper strut relative to the lower strut.

3. The assembly of claim 1 wherein:

the threaded member comprises a threaded rod.

4. The assembly of claim 3, wherein:

an upper end of the at least one strut comprises a nut bracket having an internal thread engaging the threaded rod.

5. The assembly of claim 4, wherein:

a lower end of the threaded rod below the nut bracket comprises a stop for bearing against the nut bracket.

6. The assembly of claim 3, wherein:

an upper end of the threaded rod comprises a gripping surface that permits the threaded rod to be rotated by a tool applied from above the side member.

7. The assembly of claim 3, further comprising:

a hanger element mounted to the top member, and the threaded rod is pivotally coupled to the hanger element.

8. The assembly of claim 7, wherein the top member comprises first and second channel members arranged in parallel, and the hanger element is mounted between the first and second channel members.

9. The assembly of claim 8, wherein:

the hanger element comprises a pivot pin pivotally mounted about a generally horizontal axis, and the threaded rod is coupled to the pivot pin.

10. The assembly of claim 9, wherein:

the pivot pin comprises a bore through which the threaded rod is received.

11. The assembly of claim 10, wherein:

an upper end of the threaded rod above the pivot pin comprises a stop for bearing against the pivot pin.

12. A method, comprising:

providing the assembly of claim 1; and adjusting the length of the side member.

13. The method of claim 12, wherein:

adjusting the length of the side member comprises fastening an upper strut relative to a lower strut of the side member.

14. The method of claim 13, wherein:

the step of adjusting comprises rotating a threaded rod of the side member.

15. An adjustable side member for use in a bridge overhang bracket assembly, the bridge overhang bracket assembly comprising top and diagonal members, the adjustable side member comprising:

a threaded rod for pivotal attachment to the top member;

an upper strut comprising a nut bracket having an internal thread engaging the threaded rod so that rotating the threaded member about its longitudinal axis adjusts a length of the side member; and a lower strut for pivotal attachment to the diagonal member, the lower strut fastenable to the upper strut according to a plurality of longitudinal positions to adjust the length of the side member.

16. A bridge overhang bracket assembly, comprising:

a top member extending lengthwise between inner and outer ends;

a diagonal member extending lengthwise between lower and upper ends, the top and diagonal members being pivotally attached proximate to the respective outer and upper ends thereof; and a side member extending lengthwise between bottom and top ends, the top and side members being pivotally attached proximate to the respective Inner and top ends thereof, the diagonal and side members being pivotally attached proximate to the respective lower and bottom ends thereof, the side member comprising upper and lower struts that are fastenable together in a plurality of longitudinal positions so that the length of the side member is adjustable, the side member comprising a threaded member that is coupled to the upper strut such that rotating the threaded member further adjusts the length of the side member.

* * * * *